US006089129A

United States Patent [19]

Huang

[11] Patent Number: 6,089,129

[45] Date of Patent: Jul. 18, 2000

[54] ADJUSTABLE WRENCH

[76] Inventor: Ping Wen Huang, 1F, No. 364, Sec. 2, Chung-Yang Road, Hsien-His Tsun, Chang Hua Hsien, Taiwan

[21] Appl. No.: 09/243,431

[22] Filed: Feb. 3, 1999

[51] Int. Cl.[7] ..... B25B 13/22

[52] U.S. Cl. ..... 81/133; 81/135; 81/139; 81/145; 81/165; 81/60

[58] Field of Search ..... 81/133–136, 139–140, 81/142, 145, 165, 173, 175, 58, 58.2, 60–63.2

[56] References Cited

U.S. PATENT DOCUMENTS 3,000,245 9/1961 Orr ..... 81/142 X

*Primary Examiner*—D. S. Meislin
*Attorney, Agent, or Firm*—Rosenberg, Klein & Lee

[57] ABSTRACT

An adjustable wrench including a fixed jaw, a movable jaw, a gear, an engaging block, a switch button and a grip. When tightening or untightening a nut with the adjustable wrench, it is unnecessary to repeatedly draw up the wrench and fit the wrench onto the nut. The nut can be continuously rotated. In addition, the switch button can be switched to change the rotational direction without reversing the adjustable wrench so as to facilitate operation and increase working efficiency.

4 Claims, 9 Drawing Sheets

ADJUSTABLE WRENCH

BACKGROUND OF THE INVENTION

The present invention relates to an adjustable wrench. The adjustable wrench can continuously rotate a nut without repeatedly drawing up the wrench and fitting the wrench onto the nut. In addition, a switch button can be switched to change the rotational direction without reversing the adjustable wrench.

FIG. 8 shows a conventional adjustable wrench having a fixed jaw 8 and a movable jaw 81. The fixed jaw 8 is equipped with a thread rod 82. A grip 83 is connected with lower side of the fixed jaw 8. A lower side of the movable jaw 81 is equipped with a rack 84 meshing with the thread rod 82 for adjusting the gap between the fixed jaw 8 and the movable jaw 81 in accordance with the sizes of different nuts to be tightened or untightened. There is an inconvenience existing in use of such adjustable wrench as follows: in the case that the adjustable wrench or the nut is limited in position, for example, the nut is positioned in a dent, the adjustable wrench will be unable to totally untighten or tighten the nut at one time. Under such circumstance, each time after the wrench is fitted onto two opposite sides of the nut and rotate the same by a certain angle, the wrench must be drawn up and then fitted onto two other opposite sides of the nut to further rotate the same by a certain angle. Such procedure must be repeatedly performed. Therefore, with respect to a general nut with a locking depth at least three times the pitch, it is necessary to rotate the nut through over 1080 degrees (rotating three circles=360 degrees×3) for tightening or untightening the nut. In case each time the nut can be rotated through 60 degrees, it will take 18 times repeatedly fitting actions. Such operation is quite inconvenient and will lead to a low working efficiency.

FIGS. 9 to 11 show another type of adjustable wrench having a fixed jaw 9 and a movable jaw 91. The fixed jaw 9 is equipped with a thread rod 92. A grip 93 is connected with lower side of the fixed jaw 9. A lower side of the movable jaw 91 is equipped with a rack 94. The movable jaw 91 is formed with a slide channel 95 in which a slide block 96 is disposed. The slide block 96 is disposed with a spring 97 positioned between the movable jaw 91 and the slide block 96. After the slide block 96 is moved within the slide channel 95, the spring 97 serves to restore the slide block 96 to its home position. In addition, the rack 94 meshes with the thread rod 92 for adjusting the gap between the fixed jaw 9 and the movable jaw 91 in accordance with the size of the nut. After the nut is rotated through a certain angle, the adjustable wrench is turned back, whereby the slide block 96 is pushed by the nut by reason that the distance between opposite angles is larger than the distance between opposite sides. Therefore, the slide block 96 slides outward until the slide block 96 and the fixed jaw 9 pass over the opposite angle. At this time, the spring 97 restores the slide block 96 to its home position and the wrench can be again forced to rotate the nut.

In use of such adjustable wrench, the repeated fitting actions are omitted. However, in the case that the tightening operation is converted into the untightening-operation, the wrench must be reversed. It is inconvenient to perform such action, especially when the nut is positioned in a dent and can be hardly fitted with the wrench. Moreover, in a unified operation, in order to control and unify the pre-load of the nut and bolt, the nut is often first tightened and then loosened by, for example, one third circle. Under such circumstance, immediately after the nut is tightened, the wrench must be reversed and then again fitted with the nut to untighten the same. Such procedure is quite troublesome and will lead to low working efficiency.

SUMMARY OF THE INVENTION

It is therefore a primary object of the present invention to provide an adjustable wrench including a fixed jaw, a movable jaw, a gear, an engaging block, a switch button and a grip. When tightening or untightening a nut with the adjustable wrench, it is unnecessary to repeatedly draw up the wrench and fit the wrench onto the nut and the nut can be continuously rotated. In addition, the switch button can be switched to change the rotational direction without reversing the adjustable wrench so as to facilitate operation and increase working efficiency.

The present invention can be best understood through the following description and accompanying drawings, wherein:

DETAILED DESCRIPTION OF THE PREFERRED EMBODIMENT

Figure 1:
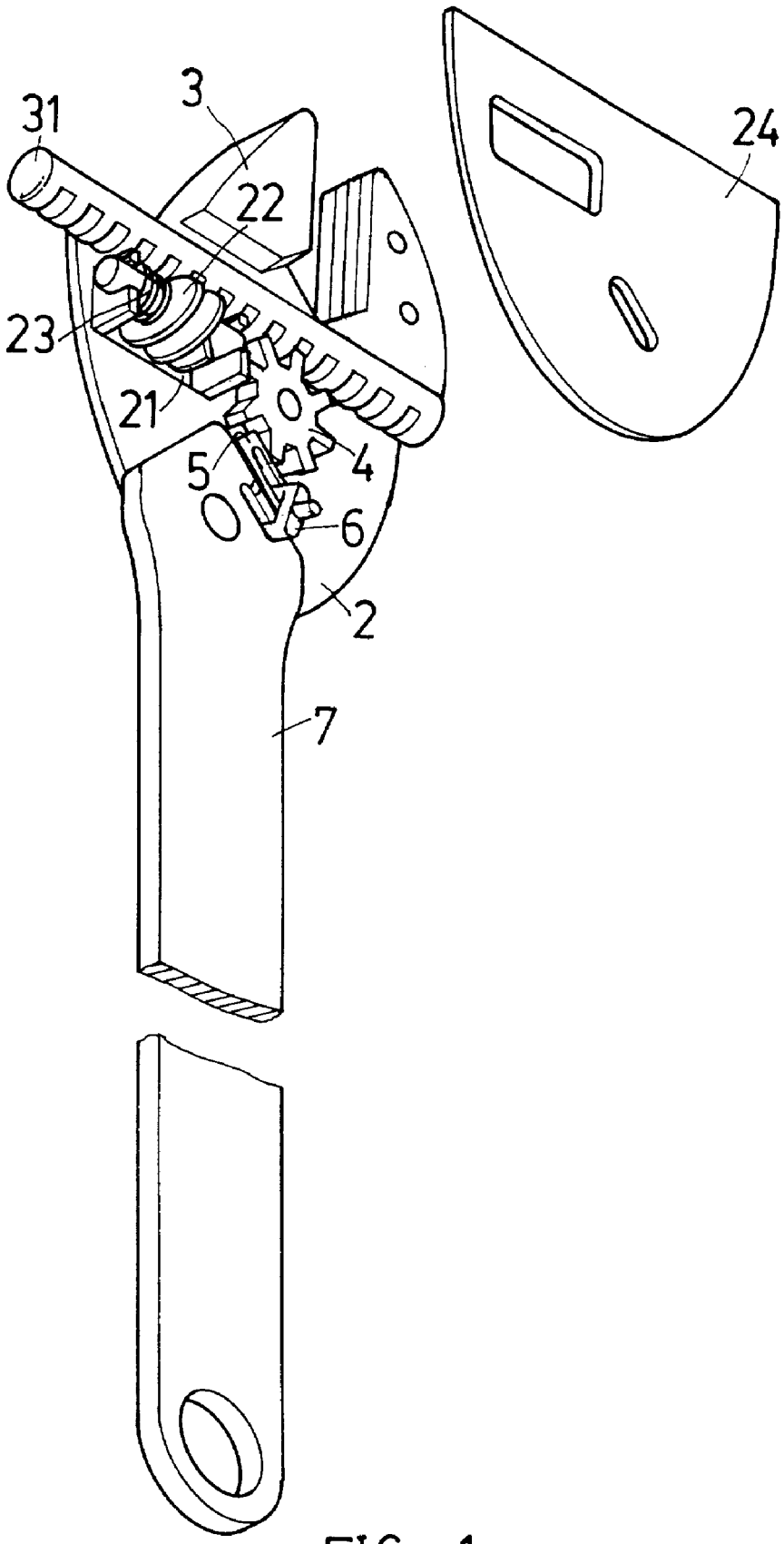
FIG. 1 is a perspective assembled view of the present invention.
Figure 2:
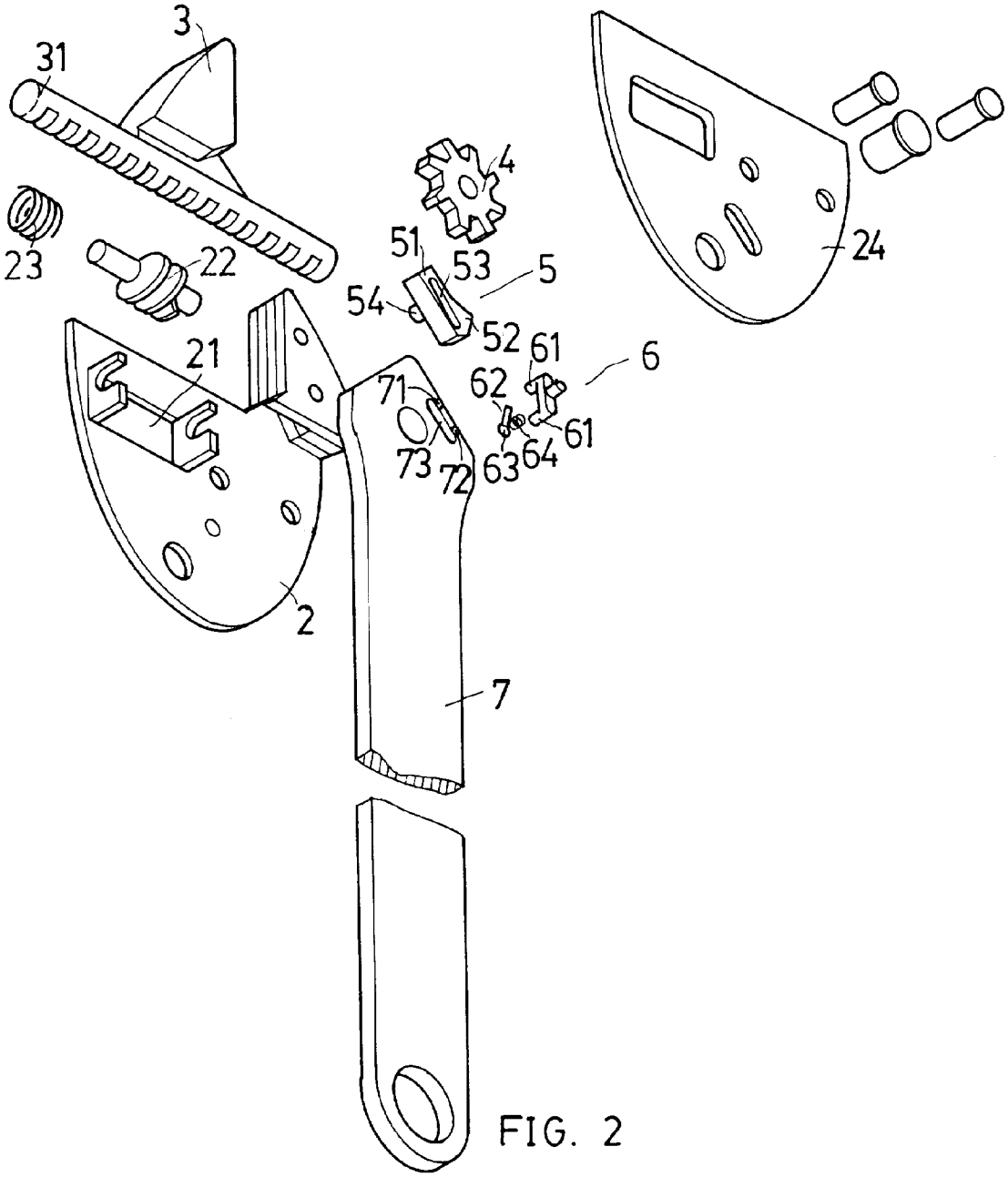
FIG. 2 is a perspective exploded view of the present invention.

Please refer to FIGS. 1 to 7. The adjustable wrench of the present invention includes a fixed jaw 2, a movable jaw 3, a gear 4, an engaging block 5, a switch button 6 and a grip 7. The fixed jaw 2 is pivotably connected to the grip 7, while the movable jaw 3 is slidable relative to the fixed jaw 2, as will be described in detail in further paragraphs.

One side of the fixed jaw 2 is formed with a perforation 21 in which a thread rod 22 is disposed. A spring 23 is fitted with one end of the thread rod 22. The other end of the spring 23 is connected with the fixed jaw 2. The other side of the fixed jaw 2 is sequentially pivotally connected with the gear 4, engaging block 5 and the grip 7. An upper cover 24 covers the fixed jaw 2 to enclose the above components between the upper cover 24 and the fixed jaw 2.

A lower side of the movable jaw 3 is disposed with a rack 31 one section of which meshes with the thread rod 22. The other section of the rack 31 meshes with the gear 4, whereby by means of rotating the thread rod 22, the distance between the fixed jaw 2 and the movable jaw 3 is changed to fit different nuts 1 with different sizes.

Two ends of the engaging block 5 are respectively formed with a first and a second engaging sections 51, 52. The engaging block 5 is further formed with an oblique travel slot 53. A bottom of the engaging block 5 is disposed with a pivot section 54 pivotally connecting with the fixed jaw 2. Accordingly, the engaging block 5 can be swung left and right about the pivot section 54.

A front section of the grip 7 is disposed with a first locating point 71, a second locating point 72 and a travel slot 73. The grip 7 is pivotally connected with the fixed jaw 2.

Figure 7:
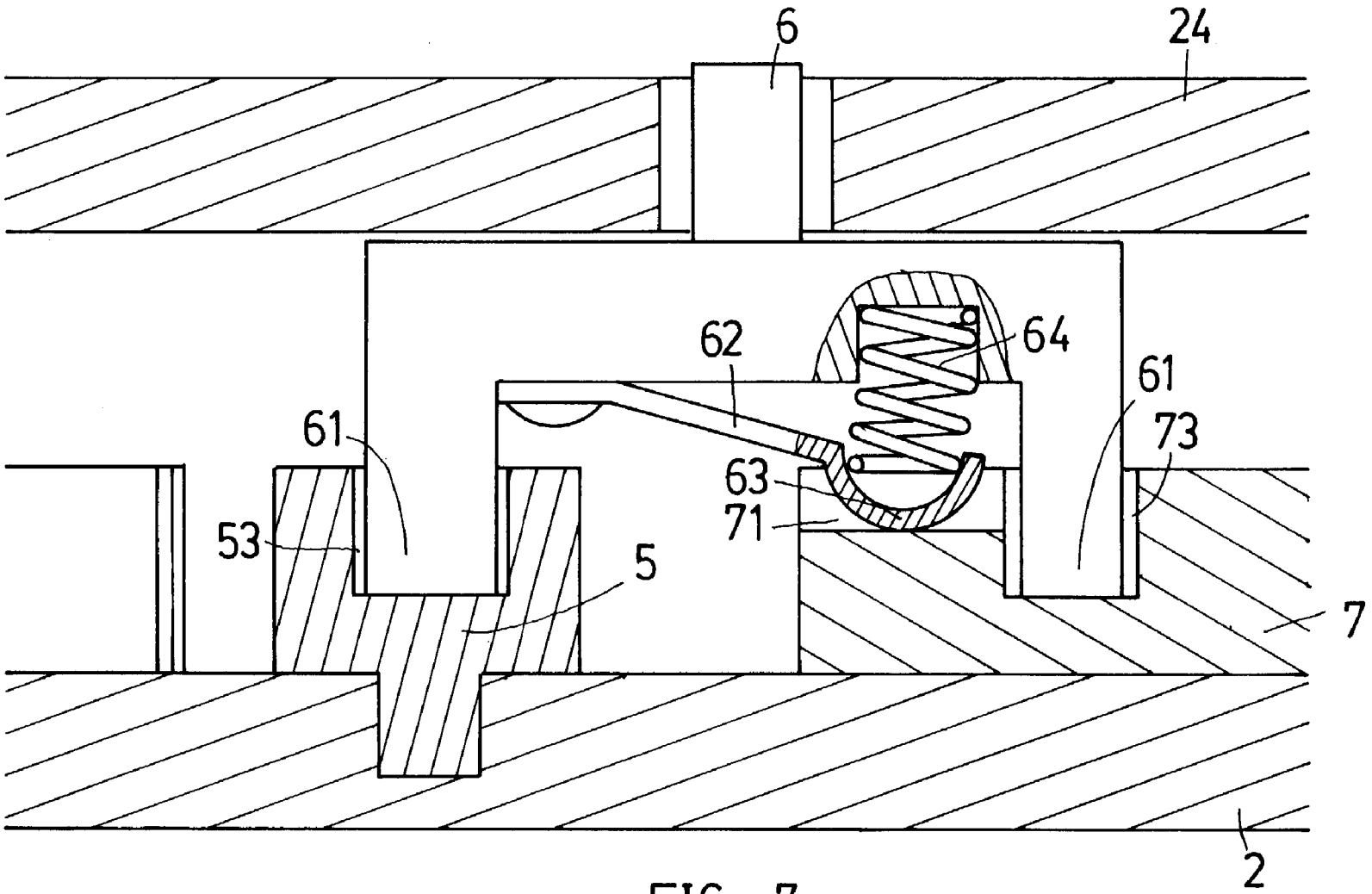
FIG. 7 is a sectional view showing the switching of the present invention.
Figure 8:
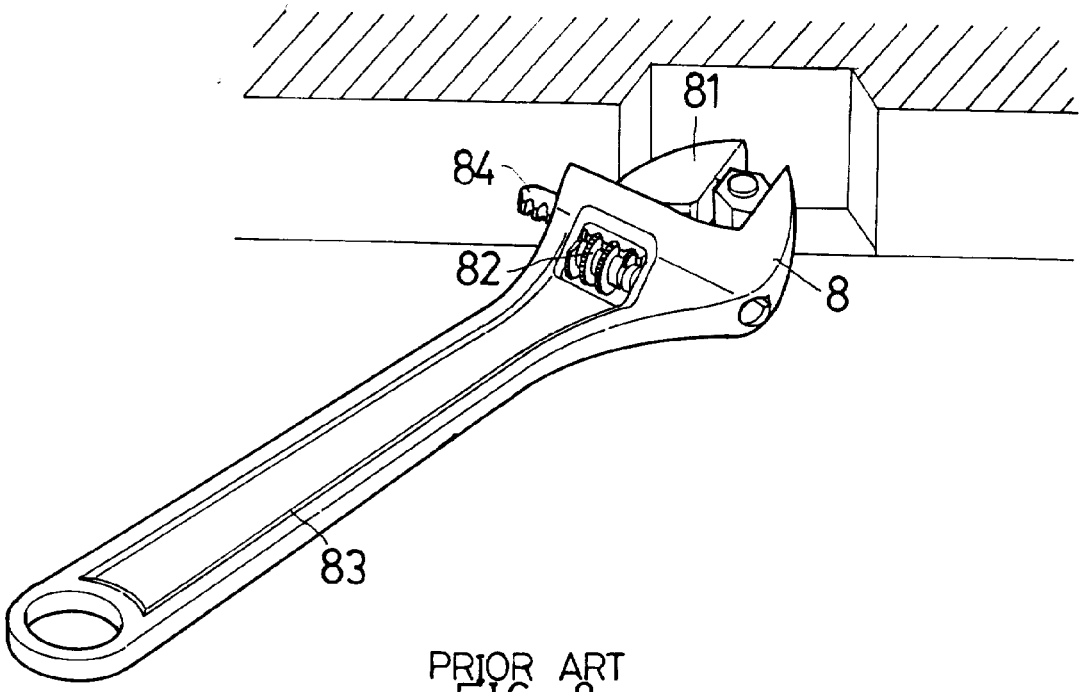
PRIOR ART FIG. 8
FIG. 8 is a perspective assembled view of a conventional adjustable wrench.
Figure 9:
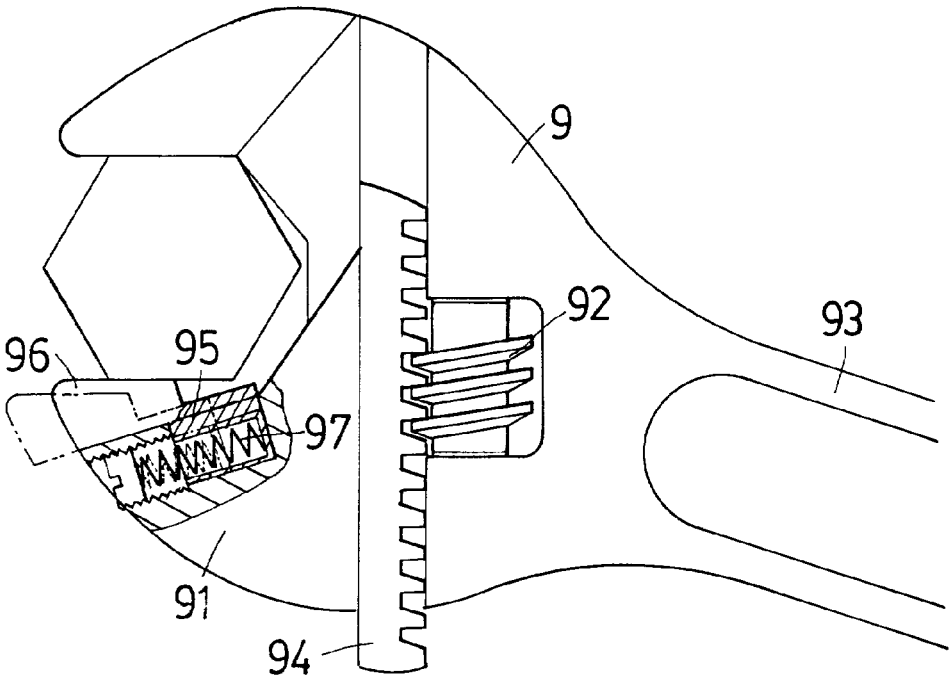
PRIOR ART FIG. 9
FIG. 9 shows the operation of another type of conventional adjustable wrench.
Figure 10:
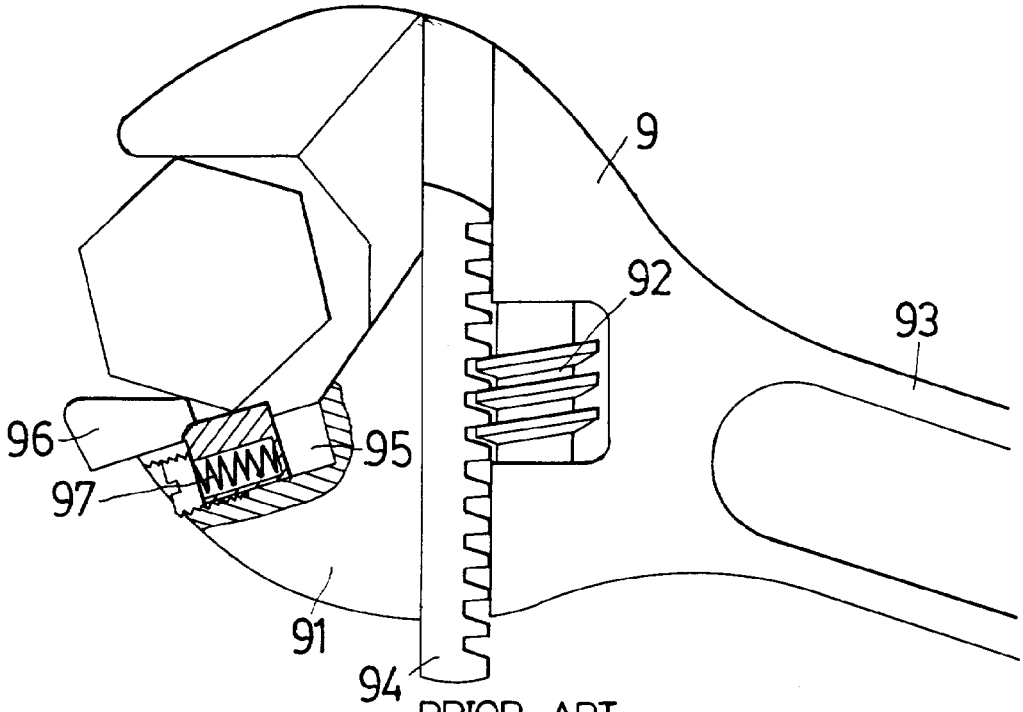
PRIOR ART FIG. 10
FIG. 10 is a view according to FIG. 9, showing that the movable jaw passes over the nut in one state.
Figure 11:
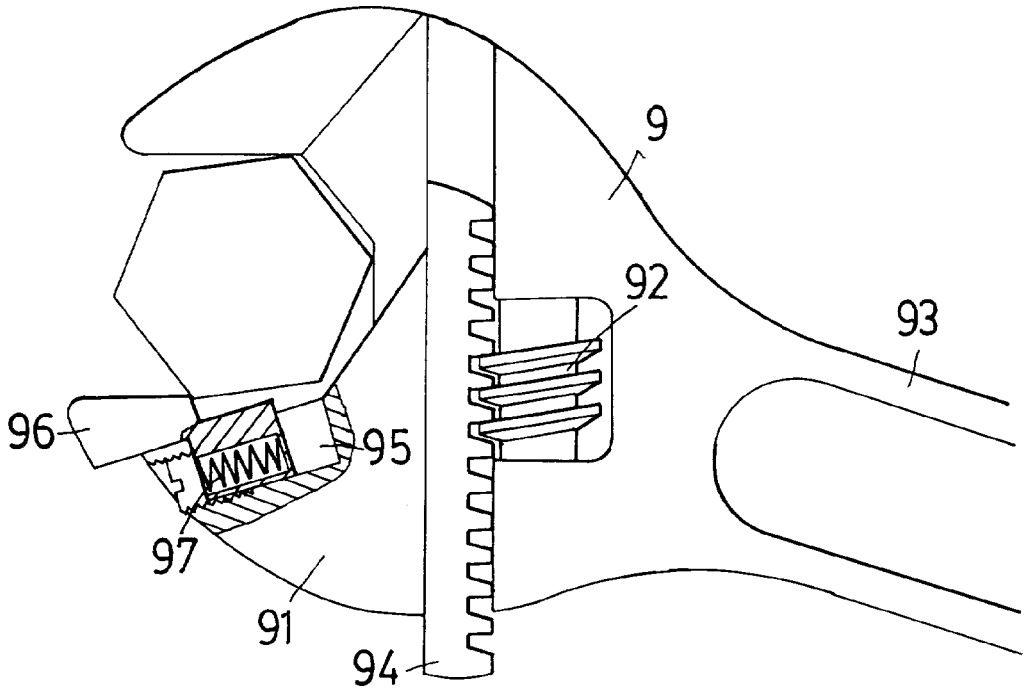
PRIOR ART FIG. 11
FIG. 11 is a view according to FIG. 9, showing that the movable jaw passes over the nut in another state.

Each end of the switch button 6 is formed with a slide rail 61 bridged between the travel slot 53 of the engaging block 5 and the travel slot 73 of the grip 7. A leaf spring 62 is disposed between the two slide rails 61. The leaf spring 62 has a convex 63 as shown in FIG. 7. The convex 63 is inserted with the first or second locating point 71, 72. A spring 64 is disposed between the convex 63 and the switch button 6. By means of the resilient force of the leaf spring 62 and the spring 64, the switch button 6 is movable between the first and second locating points 71, 72. The spring 64 serves to ensure that the convex 63 be inserted with the first or second locating point 71, 72. The switch button 6 is switched between the first and the second locating points 71, 72 so as to change the swinging angle of the engaging block 5 and fix the distances between the first engaging section 51 and the grip 7 and the second engaging section 52 and the grip 7.

Figure 3:
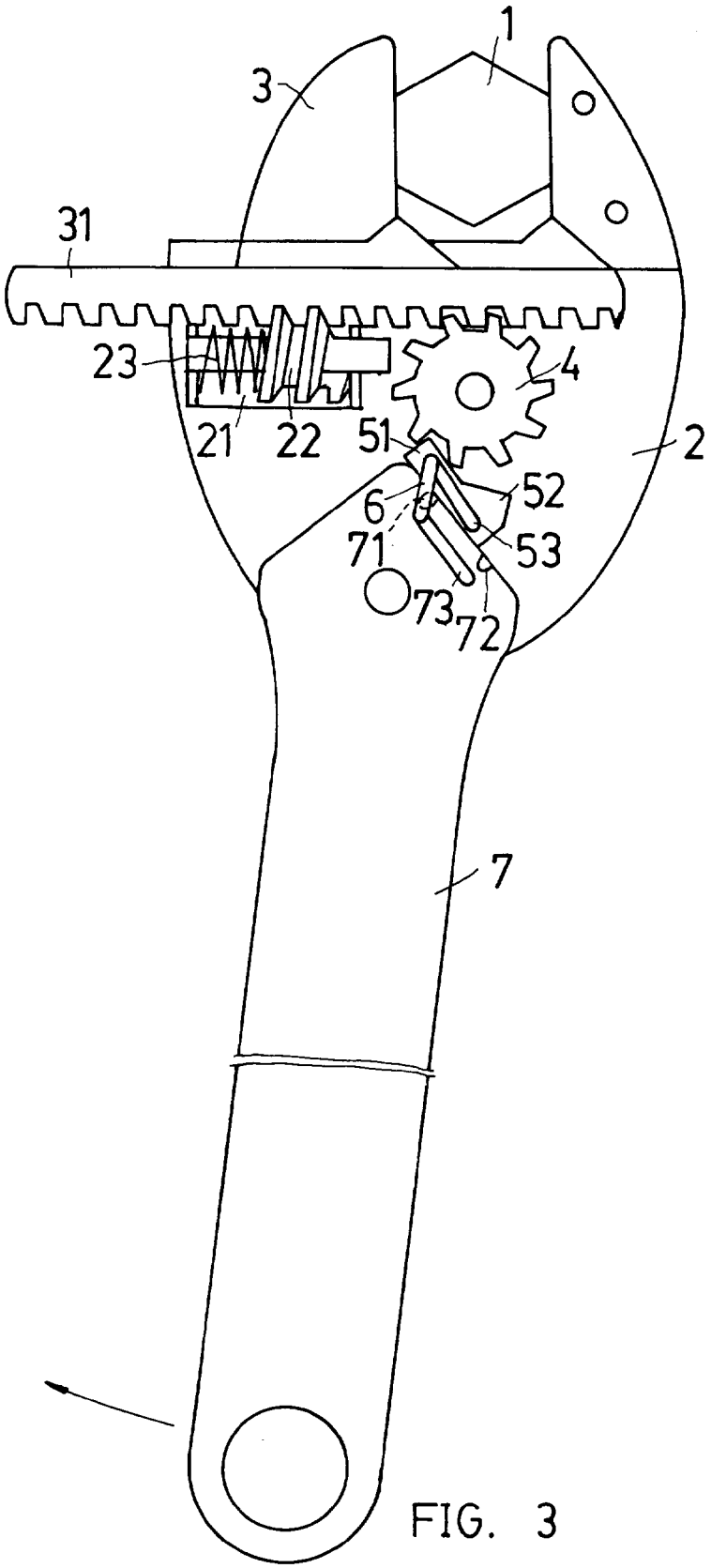
FIG. 3 shows the operation of the present invention in a clockwise rotational direction.
Figure 4:
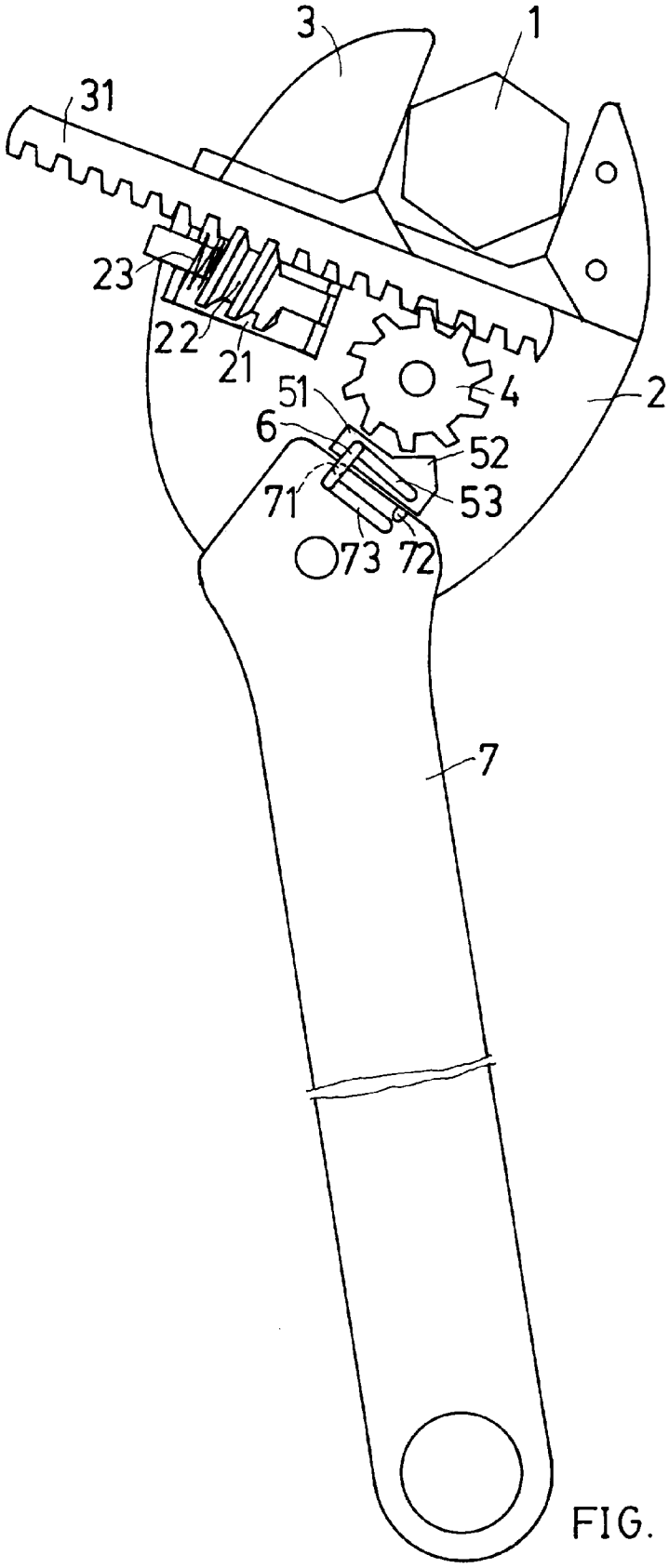
FIG. 4 is a view according to FIG. 3, showing that the movable jaw passes over the nut.

Referring to FIGS. 3 and 4, the distance between the fixed jaw 2 and the movable jaw 3 is adjusted via the thread rod 22 and fixed to clamp a nut 1 on two opposite sides thereof. The switch button 6 is switched to the first locating point 71 and the grip 7 is rotated. By means of the connection among the grip 7, the engaging block 5 and the switch button 6, the angle contained by the grip 7 and the engaging block 5 is changed, whereby the first engaging section 51 abuts against the gear 4 to clockwisely rotate the nut. After rotated through a certain angle, the grip 7 is counterclockwisely moved back so as to change the angle contained by the grip 7 and the engaging block 5. At this time, the first engaging section 51 will leave the gear 4 and two opposite angles of the nut will force away the movable jaw 3. The movable jaw 3 and the rack 31 together with the thread rod 22 compress the spring 23. The gear 4 is free from restriction of the first engaging section 51 and can be freely rotated until the fixed jaw 2 and the movable jaw 3 pass over the opposite angles. Then the spring 23 pushes the thread rod 22 back to its home position. The grip 7 is then clockwisely rotated to make the first engaging section 51 again abut against the gear 4 for rotating the nut 1. Accordingly, the operation is repeated and the inconvenience existing in numerous times fitting of the fixed jaw 2 and the movable jaw 3 is eliminated so as to increase the working efficiency.

Figure 5:
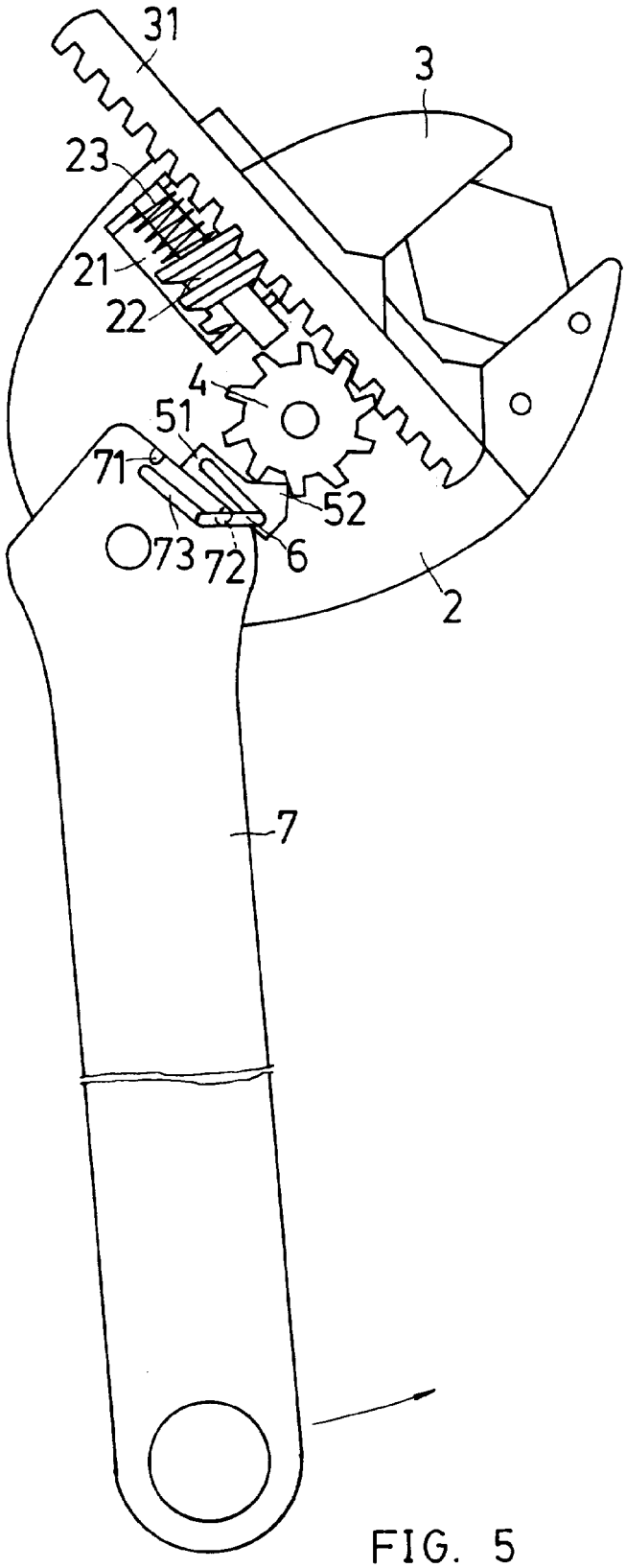
FIG. 5 shows the operation of the present invention in a counterclockwise rotational direction.
Figure 6:
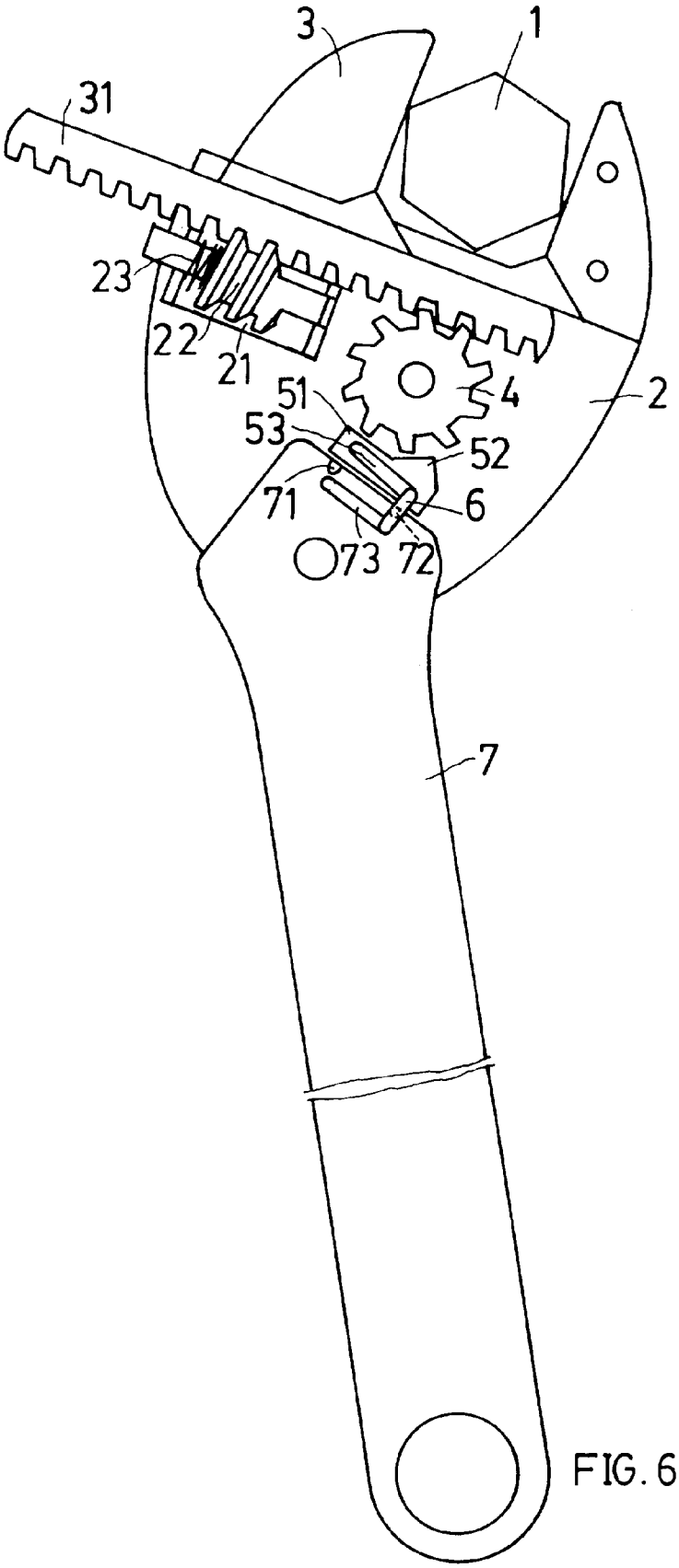
FIG. 6 is a view according to FIG. 5, showing that the movable jaw passes over the nut.

Reversely, as shown in FIGS. 5 and 6, when counter-clockwisely rotating the nut 1, the switch button 6 is switched to the second locating point 72, making the second engaging section 52 abut against the gear 4. The fixed jaw 2 and the movable jaw 3 clamp the nut 1 on two opposite sides thereof for rotating the same. After rotated through a certain angle, the grip 7 is clockwisely rotated, whereby the movable jaw 3 is forced away by the opposite angles of the nut 1. The movable jaw 3 and the rack 31 together with the thread rod 22 compress the spring 23. The gear 4 is free from restriction of the second engaging section 52 and can be freely rotated until the fixed jaw 2 and the movable jaw 3 pass over the opposite angles. Then the spring 23 pushes the thread rod 22 back to its home position. The grip 7 is then counter-clockwisely rotated to make the second engaging section 52 again abut against the gear 4 for counterclockwisely rotating the nut. Therefore, to change the tightening or untightening operation of the present invention, a user only needs to switch the switch button and then tighten or untighten the nut 1.

In conclusion, the fixed jaw 2, movable jaw 3, gear 4, engaging block 5, switch button 6 and the grip 7 of the present invention are such arranged as to facilitate the change between the tightening and untightening operation of the adjustable wrench. Accordingly, the adjustable wrench can be more conveniently used and the working efficiency is increased.

It is to be understood that the above description and drawings are only used for illustrating one embodiment of the present invention, not intended to limit the scope thereof. Any variation and derivation from the above description and drawings should be included in the scope of the present invention.

What is claimed is:

1. An adjustable wrench, comprising:

(a) a first jaw including:
- a nut engaging member and a lower member,
- a perforation defined at said lower member,
- a threaded rod positioned within said perforation, and
- a spring having one end engaging said threaded rod and another end connected to said lower member of said first jaw;

(b) a gear mechanism pivotably coupled to said lower member of said first jaw;

(c) a second jaw slidable with respect to said first jaw and including:
- a nut engaging portion and a lower portion,
- a rack positioned at said lower portion,
- said rack having a first section engaging said threaded rod on said first jaw, and further having a second section engaging said gear mechanism;

(d) a grip pivotably coupled by a front section thereof to said lower member of said first jaw,
- said grip including:
- a travel slot defined at said front section of said grip, and
- first and second locating points spaced each from the other and juxtaposed to said travel slot;

(e) an engaging block pivotably coupled to said lower member of said first jaw,
- said engaging block including:
- first and second engaging sections, and
- a travel slot obliquely extending at said engaging block between said first and second engaging sections thereof; and (f) a switch button including:
- a button member, and
- first and second slide rails extending from said button member at opposite ends thereof,
- said first slide rail being slidably received within said travel slot of said grip and traveling between said first and second locating points defined on said front section of said grip, and
- said second slide rail being slidably received within said travel slot of said engaging block;
- wherein, by engaging said first slide rail of said switch button within said first locating point on said grip, said first engaging section of said engaging block is brought into abutment with said gear mechanism by rotatively displacing said grip in a clockwise direction and is released from the abutment with said gear mechanism by rotatively displacing said grip in a counterclockwise direction, and wherein, by engaging said first slide rail of said switch button within said second locating point, said second engaging section of said engaging block is brought into abutment with said gear mechanism by rotatively displacing said grip in a counterclockwise direction and is released from abutment with said gear mechanism by rotatively displacing said grip in said clockwise direction.

2. The adjustable wrench as claimed in claim 1, further including a leaf spring engaged with the switch button, the leaf spring having a convex portion for intermittent engagement with the first and second locating points of the grip.

3. The adjustable wrench as claimed in claim 1, further including an upper cover securable to the first jaw to enclose said lower portion of the second jaw, the rack, the engaging block, said front section of said grip and the switch button between the upper cover and said first jaw.

4. The adjustable wrench as claimed in claim 2, further including a spring disposed between the convex portion of the leaf spring and the switch button.

* * * * *